US008360797B2

(12) United States Patent
Deng et al.

(10) Patent No.: US 8,360,797 B2
(45) Date of Patent: Jan. 29, 2013

(54) CONNECTOR AND CONNECTOR ASSEMBLY

(75) Inventors: Ping-Chuan Deng, Shenzhen (CN); Han-Bing Zhang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/169,048

(22) Filed: Jun. 27, 2011

(65) Prior Publication Data

US 2012/0295467 A1 Nov. 22, 2012

(30) Foreign Application Priority Data

May 18, 2011 (CN) ..... 2011 1 0128947

(51) Int. Cl.
*H01R 4/50* (2006.01)

(52) U.S. Cl. ..... 439/345

(58) Field of Classification Search ..... 439/345, 439/357, 358, 135, 296
See application file for complete search history.

(56) References Cited

U.S. PATENT DOCUMENTS

| | | | | |
|---|---|---|---|---|
| 4,245,879 | A * | 1/1981 | Buck | 439/345 |
| 6,056,578 | A * | 5/2000 | Lin | 439/358 |
| 6,386,918 | B1 * | 5/2002 | Zheng et al. | 439/607.45 |
| 6,848,932 | B2 * | 2/2005 | Bowling et al. | 439/358 |
| 6,902,432 | B2 * | 6/2005 | Morikawa et al. | 439/607.41 |
| 7,033,218 | B2 * | 4/2006 | Huang et al. | 439/607.04 |
| 7,037,120 | B1 * | 5/2006 | Yeh | 439/131 |
| 7,094,089 | B2 * | 8/2006 | Andre et al. | 439/218 |
| 7,125,267 | B1 * | 10/2006 | Yeh | 439/131 |
| 7,128,588 | B2 * | 10/2006 | Hu et al. | 439/159 |
| 7,160,137 | B1 * | 1/2007 | Yeh | 439/358 |
| 7,192,295 | B1 * | 3/2007 | Yeh | 439/350 |
| 7,223,574 | B2 * | 5/2007 | Lei et al. | 435/135 |
| 7,341,464 | B2 * | 3/2008 | Cuellar et al. | 439/135 |
| 7,465,181 | B1 * | 12/2008 | Bridges et al. | 439/358 |
| 7,524,198 | B2 * | 4/2009 | Nguyen et al. | 439/131 |
| 7,547,218 | B2 * | 6/2009 | Hiew et al. | 439/135 |
| 7,581,978 | B1 * | 9/2009 | Briant | 439/358 |
| 7,594,827 | B2 * | 9/2009 | Takamoto et al. | 439/660 |
| 7,597,570 | B2 * | 10/2009 | So | 439/172 |
| 7,618,260 | B2 * | 11/2009 | Daniel et al. | 439/37 |
| 7,635,272 | B2 * | 12/2009 | Poppe | 439/133 |
| 7,699,639 | B2 * | 4/2010 | Sun | 439/345 |
| 7,789,680 | B2 * | 9/2010 | Hiew et al. | 439/142 |
| 7,878,865 | B2 * | 2/2011 | Desrosiers et al. | 439/680 |
| 2007/0111583 | A1 * | 5/2007 | Cuellar et al. | 439/353 |

* cited by examiner

*Primary Examiner* — Amy Cohen Johnson
*Assistant Examiner* — Vladimir Imas
(74) *Attorney, Agent, or Firm* — Altis Law Group, Inc.

(57) ABSTRACT

A male universal serial bus (USB) connector includes a connection terminal and a locking piece. The locking piece includes a mounting piece fixed to a top wall of the connection terminal, an operation piece, and a connecting piece connected between the operation piece and the mounting piece. A wedge extends on the mounting piece and can be engaged in a female USB connector to prevent the male USB connector from disengaging from the female USB connector.

8 Claims, 2 Drawing Sheets

CONNECTOR AND CONNECTOR ASSEMBLY

BACKGROUND

1. Technical Field

The present disclosure relates to connectors and, more particularly, to a USB connector.

2. Description of Related Art

Universal serial bus (USB) connectors are commonly used in computers and servers. However, male USB connectors very easily become loosened from female USB connectors, which is inconvenient.

BRIEF DESCRIPTION OF THE DRAWINGS

Many aspects of the present embodiments can be better understood with reference to the following drawing. The components in the drawing are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawing, is illustrated by way of examples and not by way of limitation. It should be noted that references to "an" or "one" embodiment in this disclosure are not necessarily to the same embodiment, and such references mean at least one.

Figure 1:
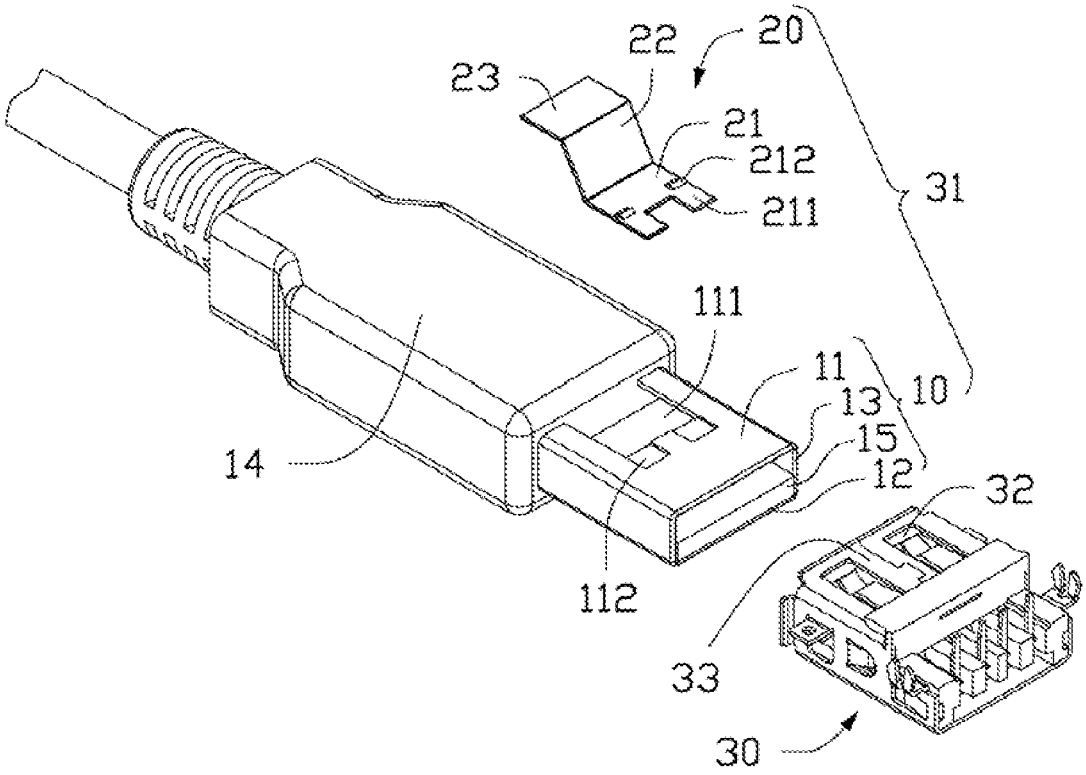
FIG. 1 is an exploded, isometric view of an embodiment of a connector assembly, the connector assembly includes a male universal serial bus (USB) connector and a female USB connector.

Referring to FIG. 1, an exemplary embodiment of a connector assembly includes a male connector 31 and a female connector 30. The male connector 31 includes a base 14, a connection terminal 10 extending from the base 14, and a locking member 20. In this embodiment, the male connector 31 is a male universal serial bus (USB) connector, and the female connector 30 is a female USB connector.

The connection terminal 10 has a rectangular cross section, and includes a terminal base 15 for electronically connecting to the female connector 30 and an enclosure receiving the terminal base 15, wherein the enclosure includes a top wall 11, a bottom wall 12 parallel to the top wall 11, and two opposite sidewalk 13 connected between corresponding sides of the top and bottom walls 11 and 12. The width of each sidewall 13 is smaller than the width of each of the top wall 11 and the bottom wall 12. The top wall 11 defines a depressed portion 111 adjacent to the base 14, and two mounting slots 112 communicating with the depressed portion 111 opposite to the base 14.

The locking member 20 is a substantially Z-shaped one-piece plate, and includes a mounting piece 21, an operation piece 23 at a distal free end of the locking member 20, and a connecting piece 22 substantially slantingly connected between the operation piece 23 and the mounting piece 21. Two spaced tabs 211 extend from a front end of the mounting piece 21 opposite to the connecting piece 22. Two spaced wedges 212 with triangle cross-section extend from a middle of the mounting piece 21.

The female connector 30 defines two spaced locking slots 32 in a top wall 31 of the female connector 30.

Figure 2:
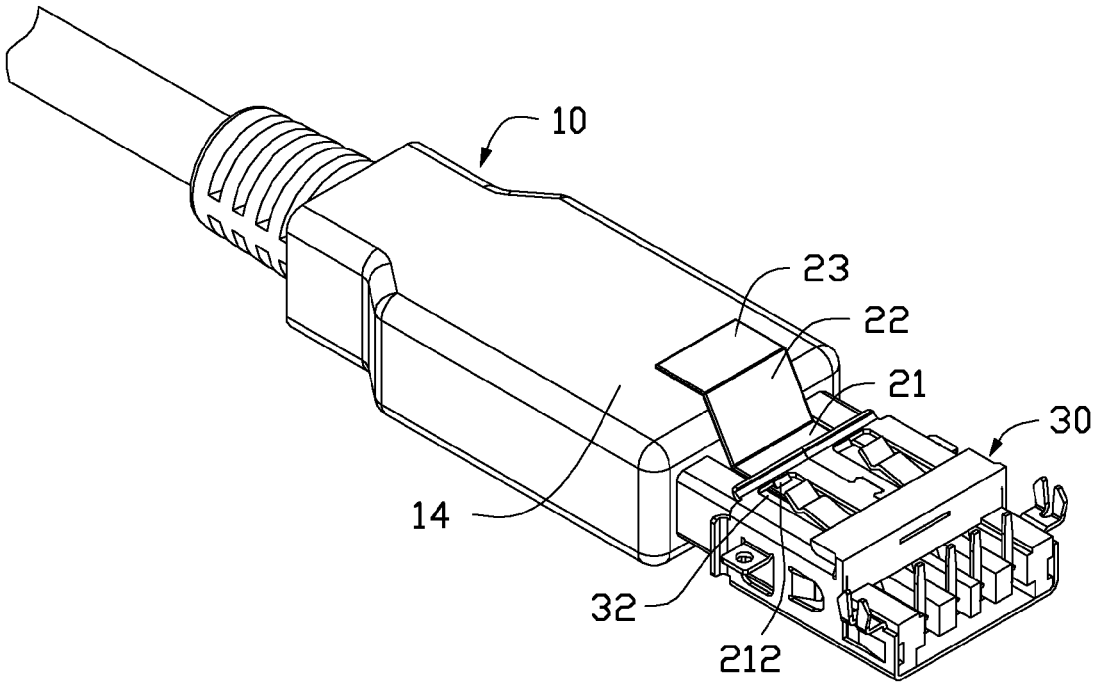
FIG. 2 is an assembled, isometric view of FIG. 1.

Referring to FIG. 2, in assembly, the locking member 20 is fixed to the top wall 11 of the connection terminal 10 through soldering or bonding, with the tabs 211 engaging in the mounting slots 112 respectively. The operation piece 23 extends away from the connection terminal 10 toward the base 14 to be above and in contact with the base 14.

In use, the connection terminal 10 is inserted into the female connector 30. The locking member 20 resists against an inner surface of the top wall 31 of the female connector 30 to be deformed, until the wedges 212 are engaged in the locking slots 32. Therefore, the wedges 212 can prevent the male connector 31 from disengaging from the female connector 30. When disassembling the male connector 31 from the female connector 30, the operation piece 23 is pressed to deform the mounting piece 21 toward the depressed portion 111 until the wedges 212 are released from the locking slots 32, and then the male connector 31 can be disassembled from the female connector 30.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A male universal serial bus (USB) connector comprising:

a connection terminal comprising a terminal base and an enclosure receiving the terminal base, wherein the enclosure comprises a top wall, a bottom wall parallel to the top wall, and two sidewalls connected between the top wall and bottom wall, wherein the top wall defines a depressed portion and two mounting slots communicating with the depressed portion; and a substantially Z-shaped one-piece locking piece comprising a mounting piece fixed to the top wall of the connection terminal, an operation piece at a distal free end of the locking piece, and a connecting piece connected between the operation piece and the mounting piece, wherein a wedge extends from the mounting piece, two spaced tabs extend from a front end of the mounting piece and are mounted in the mounting slots, respectively; wherein when the operation piece is pressed, the mounting piece is deformed toward the depressed portion.

2. The male USB connector of claim 1, wherein the width of each of the sidewalls is smaller than the width of each of the top wall and the bottom wall.

3. The male USB connector of claim 1, wherein the wedge has a triangle cross-section.

4. The male USB connector of claim 1, further comprising a base, wherein the connection terminal extends from one end of the base, the operation piece extends away from the connection terminal to be above the base.

5. A connector assembly comprising:

a female universal serial bus (USB) connector comprising a top wall defining two spaced locking slots; and a male USB connector comprising:

a connection terminal comprising a terminal base and an enclosure receiving the terminal base, wherein the enclosure comprises a top wall, a bottom wall parallel to the top wall, and two sidewalls connected between the top wall and bottom wall, wherein the top wall defines a depressed portion and two mounting slots communicating with the depressed portion; and a substantially Z-shaped one-piece locking piece comprising a mounting, piece fixed to the top wall of the connection terminal, an operation piece at a free end of the locking piece, and a connecting piece connected between the operation piece and the mounting piece, wherein two wedges extend from the mounting piece, two spaced tabs extend from a front end of the mounting piece and are mounted in the mounting slots respectively;

wherein when the connection terminal is inserted in the female USB connector with the top wall of the male USB connector abutting the top wall of the female USB connector, the wedges are locked in the locking slots of the female USB connector; and wherein when disassembling the male USB connector from the female USB connector, the operation piece is pressed to deform the mounting piece toward the depressed portion until the wedges are released from the locking slots, and then the male USB connector is ready to be disassembled from the female USB connector.

6. The connector assembly of claim 5, wherein the width of each of the sidewalls is smaller than the width of each of the top wall and the bottom wall.

7. The connector assembly of claim 5, wherein the wedges have a triangle cross-section.

8. The connector assembly of claim 5, wherein the male USB connector further comprises a base, wherein the connection terminal extends from one end of the base, the operation piece extends away from the connection terminal to be located above the base.

* * * * *